US011035189B2

(12) United States Patent
Hrupp

(10) Patent No.: US 11,035,189 B2
(45) Date of Patent: Jun. 15, 2021

(54) COMPRESSION-SET STRADDLE PACKER WITH FLUID PRESSURE-BOOSTED PACKER SET

(71) Applicant: Exacta-Frac Energy Services, Inc., Conroe, TX (US)

(72) Inventor: Joze John Hrupp, Montgomery, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 129 days.

(21) Appl. No.: 16/371,394

(22) Filed: Apr. 1, 2019

(65) Prior Publication Data

US 2020/0308921 A1 Oct. 1, 2020

(51) Int. Cl.

| | |
|---|---|
| ***E21B 33/124*** | (2006.01) |
| ***E21B 23/06*** | (2006.01) |
| ***E21B 43/26*** | (2006.01) |
| *E21B 43/11* | (2006.01) |
| *E21B 23/01* | (2006.01) |
| *E21B 10/32* | (2006.01) |
| *E21B 10/34* | (2006.01) |
| *E21B 43/12* | (2006.01) |

(52) U.S. Cl.

CPC ..... *E21B 23/06* (2013.01); *E21B 43/26* (2013.01); *E21B 10/322* (2013.01); *E21B 10/345* (2013.01); *E21B 23/01* (2013.01); *E21B 43/11* (2013.01); *E21B 43/121* (2013.01)

(58) Field of Classification Search

CPC .. E21B 33/124; E21B 33/128; E21B 33/1285; E21B 33/129; E21B 23/006; E21B 33/1295; E21B 33/12955

See application file for complete search history.

(56) References Cited

U.S. PATENT DOCUMENTS 2,225,143 A * 12/1940 Baker ..... E21B 33/128 166/119
2,781,774 A * 2/1957 Baker ..... E21B 17/14 137/493.2
3,180,437 A * 4/1965 Kellner ..... E21B 23/04 175/230
4,067,350 A * 1/1978 Raggio ..... E21B 43/123 137/155
4,279,306 A * 7/1981 Weitz ..... E21B 37/08 166/147
4,567,944 A 2/1986 Zunkel et al.

(Continued)

*Primary Examiner* — Kipp C Wallace

(74) *Attorney, Agent, or Firm* — Bennett Mullinax LLC

(57) ABSTRACT

A compression-set straddle packer with fluid pressure-boosted packer set has a two-part multicomponent mandrel and a multicomponent sliding sleeve that reciprocates within a limited range on an upper part of the two-part multicomponent mandrel. A two-part lower packer element compression sleeve in a lower part of the two-part multicomponent mandrel reciprocates on a packer element piston mandrel component and pressure-boosts compression of a lower packer element when high-pressure fluid is pumped into the straddle packer. A bias element constantly resists relative movement between the multicomponent mandrel and the multicomponent sliding sleeve and balances pressure-boost between the lower packer element and an upper packer element supported by the upper part of the two-part multicomponent mandrel.

16 Claims, 5 Drawing Sheets

(56) References Cited

U.S. PATENT DOCUMENTS

| | | | | |
|---|---|---|---|---|
| 4,590,995 | A | 5/1986 | Evans | |
| 4,671,352 | A * | 6/1987 | Magee, Jr. | E21B 34/12 166/127 |
| 4,962,815 | A | 10/1990 | Schultz et al. | |
| 5,291,947 | A | 3/1994 | Stracke | |
| 6,253,856 | B1 * | 7/2001 | Ingram | E21B 34/08 166/374 |
| 6,655,461 | B2 | 12/2003 | Eslinger et al. | |
| 6,883,610 | B2 | 4/2005 | Depiak | |
| 9,291,044 | B2 | 3/2016 | Murphy et al. | |
| 9,598,939 | B2 | 3/2017 | Lee | |
| 10,138,174 | B2 | 11/2018 | Mitchell et al. | |
| 10,180,041 | B2 * | 1/2019 | McDowell | E21B 34/103 |
| 2007/0221372 | A1 * | 9/2007 | Telfer | E21B 33/128 166/120 |
| 2014/0209321 | A1 * | 7/2014 | Hansen | E21B 33/129 166/377 |
| 2015/0376979 | A1 * | 12/2015 | Mitchell | E21B 33/124 166/373 |
| 2016/0376868 | A1 * | 12/2016 | Manke | E21B 33/1285 166/387 |
| 2020/0277835 | A1 * | 9/2020 | Hrupp | E21B 33/128 |

* cited by examiner

COMPRESSION-SET STRADDLE PACKER WITH FLUID PRESSURE-BOOSTED PACKER SET

CROSS REFERENCE TO RELATED APPLICATIONS

This is the first application filed for this invention.

FIELD OF THE INVENTION

This invention relates in general to precision fracking systems and, in particular, to a novel compression-set straddle packer with fluid pressure-boosted packer set that can be used for cased wellbore stimulation or remediation.

BACKGROUND OF THE INVENTION

Wellbore pressure isolation tools, commonly referred to as "straddle packers", are known and used to pressure isolate a downhole area of interest in a cased well bore for the purpose of what is known as focused or precision well stimulation or remediation. Straddle packers designed for this purpose are well known, but their use has been associated with operational issues that frequently render them unreliable. Most, straddle packers are also complex tools that are expensive to build and maintain.

There therefore exists a need for a novel compression-set straddle packer with fluid pressure-boosted packer set that will operate reliably in a downhole environment.

SUMMARY OF THE INVENTION

It is therefore an object of the invention to provide a compression-set straddle packer with fluid pressure-boosted packer set.

The invention therefore provides a compression-set straddle packer, comprising a two-part multicomponent mandrel, and a two-part transition sleeve between an upper part and a lower part of the two-part multicomponent mandrel, the two part transition sleeve comprising a bias element chamber that houses a bias element supported on a bias element support component of the upper part of the two-part multicomponent mandrel below a bias element push component of the upper part of the two-part multicomponent mandrel, the bias element constantly resisting movement of the upper part of the two-part multicomponent mandrel with respect to the two-part transition sleeve.

The invention further provides a compression-set straddle packer with fluid pressure-boosted packer set, comprising: a two-part multicomponent mandrel, and a two-part transition sleeve between an upper part and a lower part of the two-part multicomponent mandrel, the two part transition sleeve comprising a bias element chamber that houses a bias element supported on a bias element support component of the upper part of the two-part multicomponent mandrel below a bias element push component of the upper part of the two-part multicomponent mandrel, the bias element constantly resisting movement of the upper part of the two-part multicomponent mandrel with respect to the two-part transition sleeve; an upper packer element supported by a work string connection component of the upper part of the two-part multicomponent mandrel, and a lower packer element supported by an initial set sub mandrel component of a lower part of the two-part multicomponent mandrel; a mandrel flow sub having, at least one mandrel flow sub nozzle, the mandrel flow sub being a component of the upper part of the two-part multicomponent mandrel between the upper packer element and the lower packer element; a packer element piston mandrel component connected to a downhole end of the initial set sub mandrel component and including packer element piston ports; a two-part lower packer element compression sleeve that reciprocates on the packer element piston mandrel component and has an uphole end that abuts the lower packer element, and defines a packer element piston chamber that is in fluid communication with the packer element piston ports; whereby when high pressure fluid is pumped into the straddle packer, the high-pressure fluid exits the at least one flow sub nozzle and flows through the packer element piston ports into the packer element piston chamber to urge the uphole end of the two-part packer element compression sleeve against the lower packer element to pressure-boost the lower packer element set and the bias element equalizes the pressure-boost between the lower packer element and the upper packer element.

The invention yet further provides a compression-set straddle packer with fluid pressure-boosted packer set, comprising: a two-part multicomponent mandrel, an upper part of the two-part multicomponent mandrel having a work string connection end that supports a packer element, the multicomponent mandrel extending from the work string connection end to a connection joint of the straddle packer; an upper mandrel tube threadedly connected to the work string connection component; a mandrel flow sub having at least one mandrel flow sub nozzle connected to a downhole end of the upper mandrel tube; a lower mandrel tube connected to a downhole end of the mandrel flow sub; a bias element push component connected to a downhole end of the lower mandrel tube; a bias element support component connected to a downhole end of the bias element push component and a mandrel termination component connected to a downhole end of the bias element support component; a multicomponent sliding sleeve that surrounds the upper part of the two-part multicomponent mandrel below the work string connection end and reciprocates on the upper part of the two-part multicomponent mandrel within a limited range, the multicomponent sliding sleeve including an upper sliding sleeve connected to a compression bell that slides over a downhole end of a packer element sleeve of the work string connection component, the upper sliding sleeve sliding over the upper mandrel tube; a slotted sliding sleeve connected to a downhole end of the upper sliding sleeve, the slotted sliding sleeve sliding over the mandrel flow sub and having slotted sliding sleeve finger components that define slots that expose the at least one mandrel flow sub nozzle; a lower sliding sleeve connected to a downhole end of the slotted sliding sleeve; a transition sleeve upper end connected to a downhole end of the lower sliding sleeve; a transition sleeve lower end connected to a downhole end of the transition sleeve upper end, the upper and lower sliding sleeves providing a bias element chamber that houses the bias element push component and the bias element support component of the multicomponent mandrel; and the connection joint which is connected to the transition sleeve lower end; a bias element supported on the bias element support component of the multicomponent mandrel between the bias element push component and a lower end of the bias element chamber, the bias element constantly resisting any movement of the multicomponent sliding sleeve with respect to the multicomponent mandrel; the lower part of the two-part multicomponent mandrel comprising: an initial set sub mandrel component connected to the connection joint, the initial sub set mandrel component supporting a lower packer element; a packer element piston mandrel component connected to the initial set sub mandrel component; an unload sub mandrel component connected to the packer element piston mandrel component; and, a collar locator mandrel component connected to the unload sub mandrel component; and a two-part lower packer element sleeve having an uphole end that abuts the lower packer element, the two-part lower packer element sleeve reciprocating on the packer element piston mandrel component; a drag block/slip sub below a downhole end of the two-part lower packer element sleeve, the drag block/slip sub supporting mechanical slips for anchoring the compression-set straddle packer in a cased well bore, drag blocks for inhibiting movement of the compression-set straddle packer within the cased well bore, and an auto-J ratchet lug that engages an auto-J ratchet groove in a downhole end of the packer element piston mandrel component; a lower tandem sub connected to the drag block/slip sub; an unload sub sleeve connected to the tandem sub and reciprocating on the unload sub mandrel component; and a collar locator sleeve that supports collar locator ribs, the collar locator sleeve reciprocating on the collar locator mandrel component.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
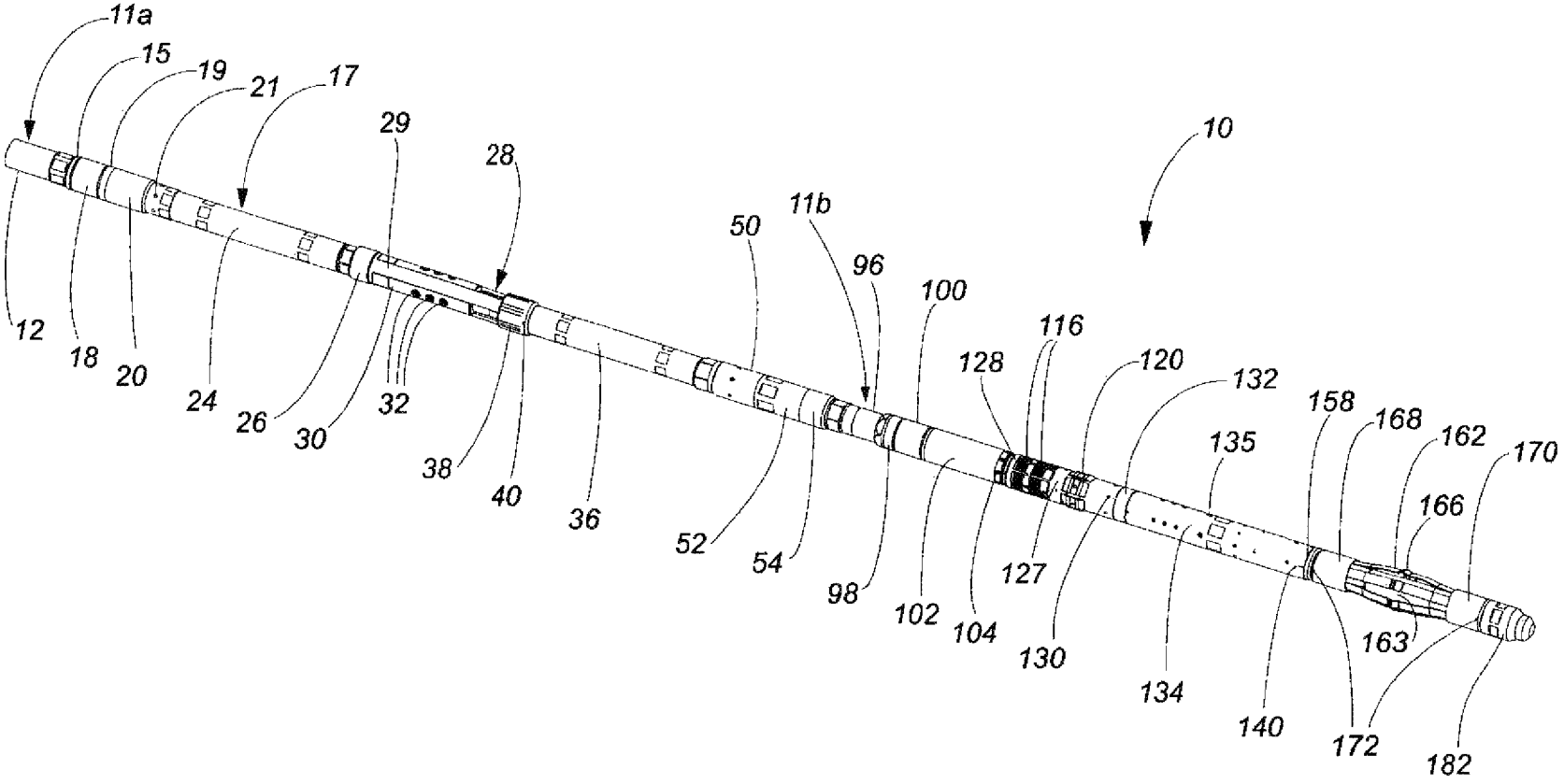
FIG. 1 is a perspective view of an embodiment of a compression-set straddle packer with fluid pressure-boosted packer set in accordance with the invention.

The invention provides a compression-set straddle packer with pressure-boosted packer set (hereinafter simply "straddle packer") to provide a straddle packer that may be used in precision well stimulation or remediation treatments in cased well bores (hereinafter referred to simply as "well bores"). The straddle packer has a two-part multicomponent mandrel and a multicomponent sliding sleeve that surrounds an upper part of the two-part multicomponent mandrel and reciprocates within a limited range over the upper part of the two-part multicomponent mandrel. The upper part of the two-part multicomponent mandrel includes a mandrel flow sub component. The mandrel flow sub has at least one abrasion-resistant fluid nozzle used to inject well stimulation or well remediation fluid (hereinafter referred to collectively as "high pressure fluid") into a section of a wellbore that is pressure isolated by upper and lower packer elements of the straddle packer when the respective packer elements are in a packer set condition. In this document, "flow sub nozzle" means any orifice, permanent or interchangeable, through which high pressure fluid may be pumped, including but not limited to a bore and a slot. In the packer set condition the respective packer elements are in high-pressure sealing contact with a wellbore. The respective packer elements are compressed to the packer set condition by work string weight applied at surface to a work string connected to the straddle packer. When high pressure fluid is pumped into the straddle packer it urges a hydraulic cylinder component of the lower part of the two-part multi-component mandrel to further compress the upper and lower packer elements to boost a seal strength of the respective, packer elements. The higher the fluid pressure in the straddle packer, the greater the boost to packer compression. A bias element is captured between a bias element push component of the upper part of the two-part multicomponent mandrel and a lower end of a bias element chamber provided between the upper and lower parts of the two-part multicomponent mandrel. The bias element constantly resists relative movement of the upper part of the two-part multicomponent mandrel with, respect to the multicomponent sliding sleeve to distribute compression pressure on the upper and lower packer elements when the straddle packer is in a fluid pressure-boosted set condition.

An auto-J latch maintains the straddle packer in a run-in condition to prevent packer set in an event that an obstruction is "tagged" while running the straddle packer into a cased well bore. Work string manipulation, well understood in the art, is used to shift the auto-J latch to a packer set condition. High-pressure fluid may then be pumped through the work string into the pressure isolated section of the well bore. When the high-pressure fluid treatment is completed and string weight is released from the work string, the bias element assists unsetting of the respective packers. In one embodiment the bias element is an elastomeric tube received on the upper part of the two-part multicomponent mandrel. In one embodiment, the multicomponent mandrel includes ports under the bias element and the bias element chamber wall includes ports above the bias element. When the packer elements are set, the bias element seals the respective ports in the multicomponent mandrel and the bias element chamber wall. When string weight is released from the uphole end, the bias element relaxes and opens the respective ports, which permits fluid in the multicomponent mandrel to flow around opposite ends of the bias element and into the well bore, which may facilitate recovery from a "screen-out" should one occur. The straddle packer is also provided with a fluid dump sub downhole of the respective packer elements, which automatically dumps fluid from the straddle packer when the straddle packer is moved from the packer set to the run-in condition.

| Part No. | Part Description |
|---|---|
| 10 | Compression-set straddle packer |
| 11a | Multicomponent mandrel upper part |
| 11b | Multicomponent mandrel lower part |
| 12 | Work string connection component |
| 13 | Multicomponent mandrel central passage |
| 14 | Work string connection |
| 15 | Packer element compression shoulder |
| 16 | Packer element sleeve |
| 17 | Multicomponent sliding sleeve |
| 18 | Upper packer element |

-continued

| Part No. | Part Description |
|---|---|
| 19 | Upper packer element compression ring |
| 20 | Compression bell |
| 21 | Compression bell pressure equalization ports |
| 22 | Upper crossover tube |
| 23 | Upper mandrel tube |
| 24 | Upper sliding sleeve |
| 26 | Upper sliding sleeve coupling |
| 27 | Slotted sliding sleeve female coupling end |
| 28 | Slotted sliding sleeve |
| 29 | Sliding sleeve finger components |
| 30 | Mandrel flow sub |
| 31 | Mandrel flow sub grooves |
| 32 | Mandrel flow sub nozzles |
| 34 | Lower sliding sleeve coupling |
| 36 | Lower sliding sleeve |
| 38 | Slotted sliding sleeve captured end coupling ring |
| 40 | Cap screws |
| 42 | Lower mandrel tube |
| 44 | Bias element push component |
| 46 | Bias element support component |
| 48 | Upper mandrel part termination component |
| 50 | Transition sleeve upper end |
| 52 | Transition sleeve lower end |
| 54 | Connection joint |
| 56 | Bias element chamber |
| 58 | Bias element elastomeric tube |
| 60 | Upper bias element push ring |
| 62 | Lower bias element push ring |
| 64 | Mandrel ports |
| 66 | Transition sleeve ports |
| 80 | Bias element compression spring |
| 96 | Initial set sub mandrel component |
| 98 | Lower packer element compression ring |
| 100 | Lower packer element |
| 102 | Two-part lower packer element compression sleeve |
| 104 | Lower compression sleeve pressure balance ports |
| 106 | Packer element piston ports |
| 108 | Packer element piston mandrel component |
| 110 | Packer element piston |
| 112 | Packer element piston chamber |
| 116 | Mechanical slips |
| 118 | Mechanical slip springs |
| 120 | Drag blocks |
| 122 | Drag block bow springs |
| 124 | Auto-j ratchet lug |
| 126 | Auto-j ratchet groove |
| 126a | Auto-j ratchet neutral notch |
| 126b | Auto-j ratchet slip engage notch |
| 126c | Auto-j ratchet shift notch |
| 127 | Drag block/slip sub |
| 128 | Drag block/slip retainer ring |
| 130 | Drag block/slip retainer screws |
| 132 | Lower tandem sub |
| 134 | Unload sub sleeve |
| 135 | Unload sub sleeve ports |
| 136 | Unload sub mandrel component |
| 137 | Unload sub mandrel ports |
| 140 | Cap screws |
| 150 | Captive seal |
| 152 | Captive seal ring |
| 158 | Unload sub end cap |
| 161 | Collar locator mandrel component |
| 162 | Collar locator ribs |
| 163 | Collar locator sleeve |
| 166 | Collar locator hooks |
| 168 | Upper collar locator retainer ring |
| 170 | Lower collar locator retainer ring |
| 172 | Collar locator retainer screws |
| 182 | Straddle packer guide cap |

FIG. 1 is a perspective view of one embodiment of a compression-set straddle packer with fluid pressure-boosted packer set 10 (hereinafter simply "straddle packer 10") in accordance with the invention. The straddle packer 10 has a two-part multicomponent mandrel 11*a* (upper part) and 11*b* (lower part), the majority of which can only be seen in a cross-sectional view (see FIGS. 2-4). The multicomponent mandrel upper part 11*a* is surrounded by a multicomponent sliding sleeve 17, which reciprocates within a limited range over the multicomponent mandrel upper part 11*a*. The multicomponent mandrel upper part 11*a* includes a work string connection component 12 with a work string connection 14 (see FIG. 2). A configuration of the work string connection 14 is a matter of design choice and dependent on whether the straddle packer 10 is to be operated using a coil tubing string (not shown) or jointed tubing string (not shown), as is well understood in the art.

The work string connection component 12 has a packer element compression shoulder 15 and a packer element sleeve 16 (see FIG. 2) that supports an elastomeric upper packer element 18, the function of which is well understood in the art. On a downhole side of the upper packer element 18 is a packer element compression ring 19 that slides on the packer element sleeve 16. A compression bell 20, having compression bell pressure equalization ports 21, is a component of the multicomponent sliding sleeve 17 and is connected to an upper sliding sleeve 24. The upper sliding sleeve 24 is connected to an upper sliding sleeve female coupling end 26 of a slotted sliding sleeve 28, having a female coupling end 27 (see FIG. 2) connected to a lower sliding sleeve 36. In one embodiment, the slotted sliding sleeve 28 has three slotted sliding sleeve finger components 29 that are respectively received in sliding sleeve slots mandrel flow sub grooves 31 (see FIG. 2) of a mandrel flow sub 30 of the multicomponent mandrel upper part 11*a*. The slotted sliding sleeve finger components 29 define three slots that respectively expose at least one mandrel flow sub nozzle 32 of the mandrel flow sub 30. In this embodiment, the mandrel flow sub 30 has a plurality of mandrel flow sub nozzles 32. It should be understood the number of mandrel flow sub nozzles 32 is a matter of design choice. A downhole end of the sliding sleeve finger components 29 are threadedly connected to a slotted sliding sleeve captured end coupling ring 38 that surrounds a lower sliding sleeve coupling 34 (see FIG. 2) that is threadedly connected to the lower sliding sleeve 36. Cap screws 40 secure the captured end coupling ring 38. A downhole end of the lower sliding sleeve 36 is connected to a transition sleeve upper end 50 that is in turn connected to a transition sleeve lower end 52. A connection joint 54 is connected to a lower end of the transition sleeve lower end 52. One or more extension pipes (not shown) may be connected to the connection joint 54 to extend a "reach" of the straddle packer 10 (length of cased wellbore pressure-isolated by the straddle packer 10).

A downhole end of the connection joint 54 is threadedly connected (directly or via the above-referenced extension pipes) to an uphole end of the multicomponent mandrel lower part 11*b*, which includes an initial set sub mandrel component 96 that supports a lower packer element compression ring 98 and a lower packer element 100. A two-part lower packer element compression sleeve 102 surrounds a packer element piston mandrel component 108 (see FIG. 2) threadedly connected to a downhole end of the initial set sub mandrel component 96. The lower part of the two-part lower packer element compression sleeve 102 includes lower compression sleeve pressure balance ports 104.

The down hole end of the two-part lower packer element compression sleeve 102 is conical and serves as an upper slip ramp to set mechanical slips 116 which are retained by a drag block/slip sub 127, as will be explained below with reference to FIG. 4. The mechanical slips 116 are normally urged to an unset condition (shown in this view) by mechanical slip springs 118 (see FIG. 2) retained by the drag block/slip retainer ring 128. As will be explained below with reference to FIGS. 4 and 5*b*, the mechanical slips 116 may be set using work string manipulation to shift an auto-J ratchet of the straddle packer 10. The drag block/slip sub 127 includes a downhole slip ramp for setting the mechanical slips 116 in cooperation with the two-part lower packer element compression sleeve 102, as will be explained below with reference to FIG. 5*b*. The drag block/slip sub 127 also retains drag blocks 120, which are normally urged into engagement with a well bore casing (not shown) by drag block bow springs 122 (see FIG. 2) to provide frictional resistance as the straddle packer 10 is run into a cased well bore using the work string. The drag block/slip sub 127 also supports an auto-J ratchet lug 124 (see FIG. 2) which cooperates with an auto-J ratchet groove 126 (better seen in FIGS. 5*a* and 5*b*) milled into a downhole end of the packer element piston mandrel component 108 (see FIG. 2). The operation of the auto-J ratchet will be explained below with reference to FIGS. 4, 5*a* and 5*b*.

Threadedly connected to a downhole end of the drag block/slip sub 127 is a lower tandem sub 132, which is secured from rotation by drag block/slip retainer screws 130. Connected to a downhole end of the lower tandem sub 132 is an unload sub sleeve 134 having unload sub sleeve ports 135, the function of which will be explained below with reference to FIGS. 2 and 4. Cap screws 140 secure an unload sub end cap 158 to the unload mi sleeve 134. A collar locator sleeve 163 floats on a lower end of the multicomponent mandrel lower part 11*b*. An upper collar locator ring 168 connected to an uphole end of the collar locator sleeve 163 captures an uphole end of a plurality of collar locator ribs 162. The upper collar locator ring 168 is secured by a plurality of collar locator retainer screws 172 to the collar locator sleeve 163. A lower collar locator retainer ring 170 captures the downhole ends of the collar locator ribs 162, and is likewise secured to the collar locator sleeve by a plurality of collar locator retainer screws 172. As is well understood by those skilled in the art, the collar locator ribs 162 have respective collar locator hooks 166 which "catch" an end of a casing joint as the straddle packer 10 is pulled uphole and the collar locator hooks 166 pass through a casing collar (not shown), which is detectable on the surface as a spike in string weight on an operator's string weight gauge that alerts the operator that a collar in the casing string has been located. A straddle packer guide cap 182 is connected to a downhole end of the lower mandrel part 11*b* of the two-part multicomponent mandrel.

Figure 2:
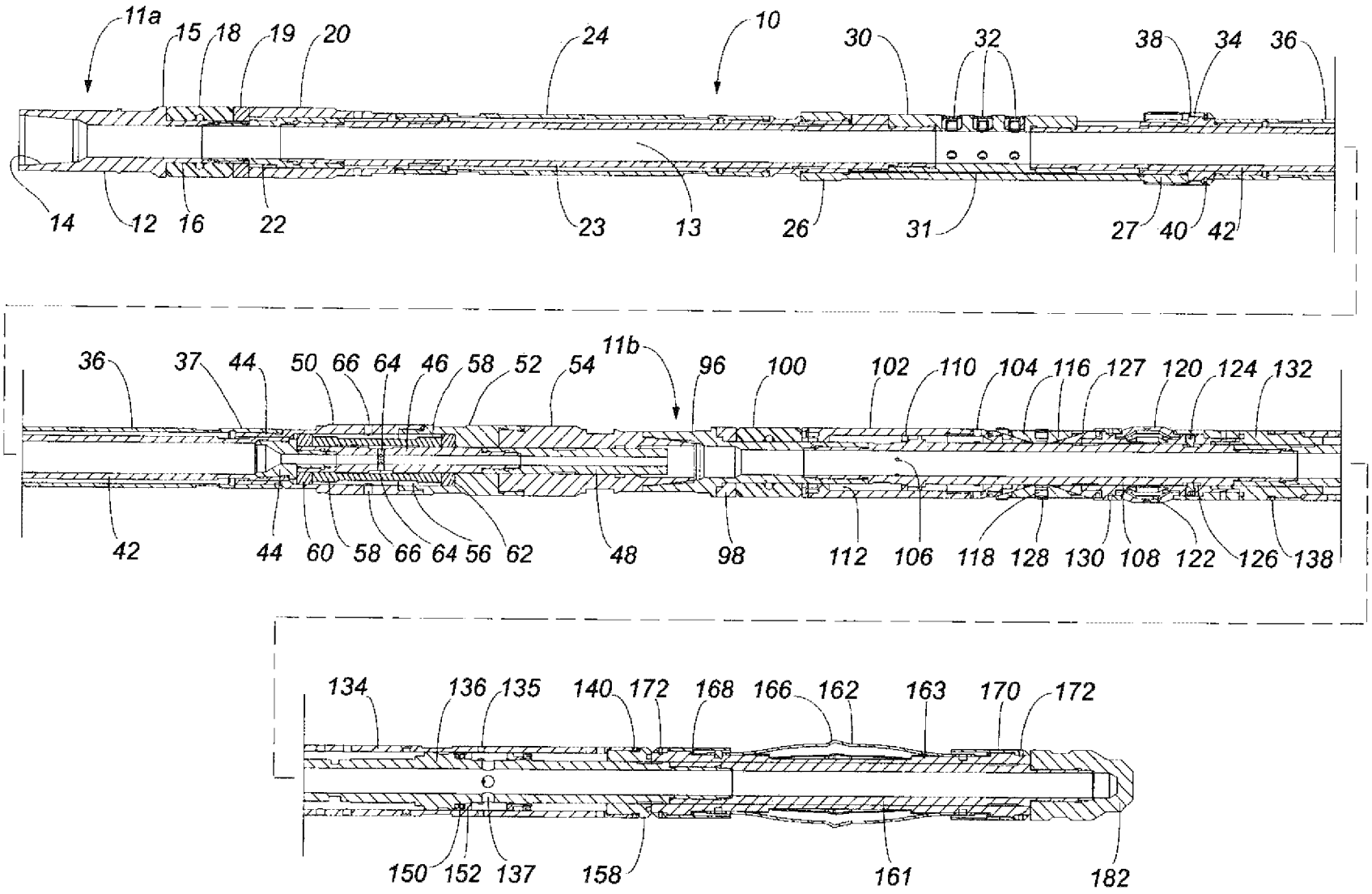
FIG. 2 is a cross-sectional view of one embodiment of the compression-set straddle packer with fluid pressure-boosted packer set shown in FIG. 1, in a run-in condition.

FIG. 2 is a cross-sectional view of the straddle packer 10 shown in FIG. 1. As explained above, the elastomeric upper packer element 18 is supported on the packer element sleeve 16 of the work string connection component 12 of the multicomponent mandrel upper part 11*a*. The multicomponent mandrel parts 11*a* and 11*b* have a central passage 13 that provides an uninterrupted fluid path from the work string connection 14 to the straddle packer guide cap 182 of the straddle packer 10. The multicomponent mandrel upper part 11*a* includes the following interconnected components: the work string connection component 12, which is threadedly connected to an upper crossover tube 22; an upper mandrel tube 23 threadedly connected to a lower end of the upper crossover tube 22; the mandrel flow sub 30 connected to a downhole end of upper mandrel tube 23; the wear-resistant, replaceable mandrel flow sub nozzle(s) 32; a lower mandrel tube 42 connected to a downhole end of the mandrel flow sub 30; a bias element push component 44 connected to a downhole end of the lower mandrel tube 42; a bias element support component 46 having mandrel ports 64 connected to a downhole end of the bias element push component 44; an upper mandrel part termination component 48 connected to a lower end of the bias element support component 46.

The multicomponent mandrel lower part 11*b* includes the packer element piston mandrel component 108 threadedly connected to a downhole end of the initial set sub mandrel component 96. An unload sub mandrel component 136 is threadedly connected to a downhole end of the packer element piston mandrel component 108. The unload sub mandrel component 136 includes unload sub mandrel ports 137, which are in fluid communication with the unload sub sleeve ports 135 when the straddle packer 10 is in the run-in condition. This permits any fluid in the central passage 13 to flow out of the straddle packer 10 and into an annulus of a cased well bore, and permits the straddle packer 10 to rapidly return from a packer element set condition to the run-in condition after string weight is released from the straddle packer 10. A collar locator mandrel component 161 is threadedly connected to a downbole end of the unload sub mandrel component 136. The straddle packer guide cap 182 is threadedly connected to a downhole end of the collar locator mandrel component 161.

All of the external components of the straddle packer 10 have been described above with reference to FIG. 1. However, there is an important operative component of the straddle packer 10 that has not been described. Namely, a bias element housed in a bias element chamber 56 within the transition sleeve upper end 50 and the transition sleeve lower end 52. In one embodiment the bias element is a bias element elastomeric tube 58 carried on the bias element support component 46. In another embodiment, the bias element is a bias element compression spring 80 (see FIG. 3) carried on the bias element support component 46. In one embodiment the bias element elastomeric tube 58 is cast from a hydrogenated nitrile butadiene rubber (HNBR) having a durometer of at least 90. An upper bias element push ring 60 abuts an upper end of the bias element elastomeric tube 58. A lower bias element push ring 62 abuts a lower end of the bias element elastomeric tube 58. Both the upper bias element push ring 60 and the lower bias element push ring 62 float on the bias element support component 46. The bias element elastomeric tube 58 constantly resists any movement of the upper bias element push ring 60 toward the lower bias element push ring 62, and vice versa, thus resisting any relative movement of the multicomponent sliding sleeve 17 over the multicomponent mandrel 11. As will be explained below with reference to FIG. 4, the bias element elastomeric tube 58 (or a bias element compression spring 80, see FIG. 3) respectively serve several important functions in the operation of the straddle packer 10.

Figure 3:
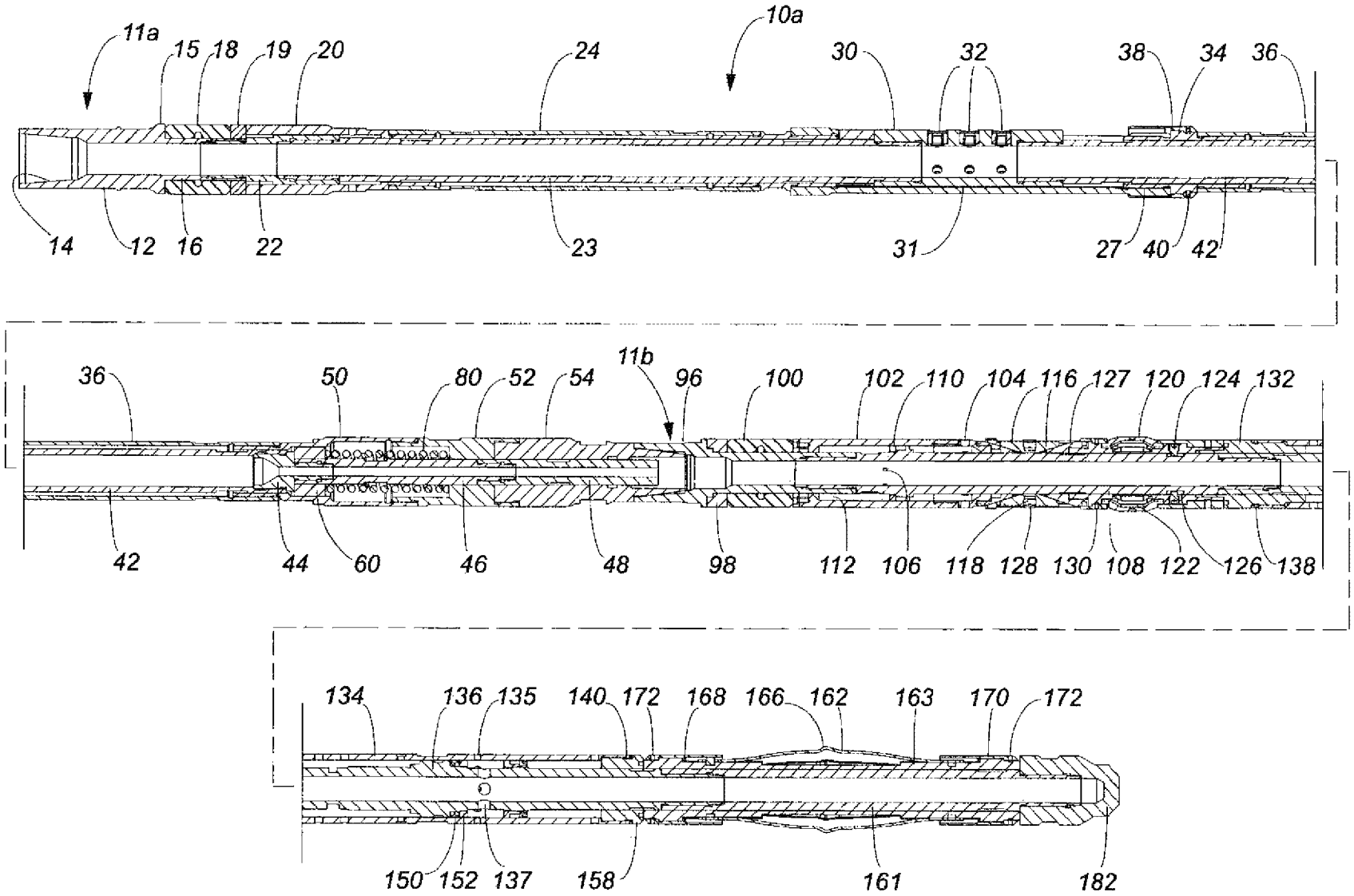
FIG. 3 is a cross-sectional view of another embodiment of the compression-set straddle packer with fluid pressure-boosted packer set shown in FIG. 1, in a run-in condition.

FIG. 3 is a cross-sectional view another embodiment 10*a* of the straddle packer 10. All of the components and features of the straddle packer 10*a* have been described above with reference the straddle packer 10 shown in FIGS. 1 and 2, except that the bias element of the straddle packer 10*a* is the bias element compression spring 80. In one embodiment, the straddle packer 10*a* also includes only the upper bias element push ring 60, and the bias element support component 46 has no ports. Furthermore, there are no fluid ports in the transition sleeve upper end 50. In one embodiment of the straddle packer 10*a*, the bias element compression spring 80 is preloaded with about 2,000 pounds of compression when the straddle packer 10*a* is assembled, and maintains that tension in a run-in condition of the straddle packer 10*a* to ensure the upper and lower packer elements 18, 100 do not begin to set if the straddle packer 10*a* "tags" a minor obstruction while it is being run into a cased well bore. The straddle packer 10*a* is operated in the same manner as the straddle packer 10, which is described below with reference to FIGS. 4, 5*a* and 5*b*.

Figure 4:
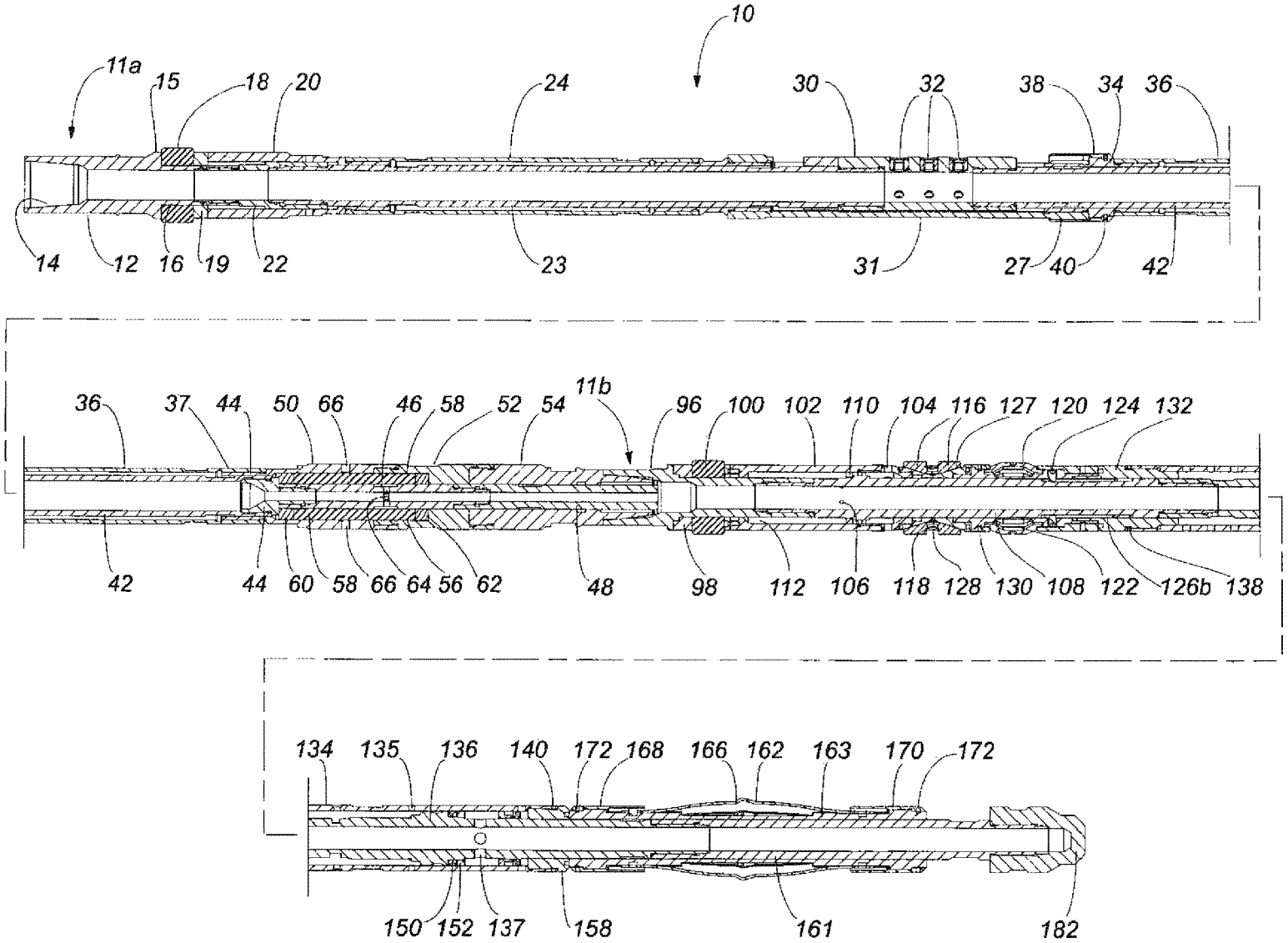
FIG. 4 is a cross-sectional view of the compression-set straddle packer with fluid pressure-boosted packer set shown in FIG. 2, illustrating the straddle packer as it would appear if the straddle packer were in a fluid pressure-boosted, packer-set condition.

FIG. 4 is a cross-sectional view of the straddle packer 10 showing the straddle packer 10 as it would appear if it were in a pressure-boosted packer-set condition. As will be explained below with reference to FIGS. 5*a* and 5*b*, after an area of interest is located in a cased well bore, the straddle packers 10, 10*a* may be shifted from the run-in condition, shown respectively in FIGS. 2 and 3, to a packer set condition using work string manipulation to shift the auto-J ratchet lug 124 into an auto-J ratchet slip-engage notch 126*b*, and applying string weight to the work string in a manner well known in the art. When work string weight is applied to the work string connection component 12 the straddle packer 10, 10*a* is urged downhole against a resistance of the drag blocks 120, which begins to compress upper packer element 18 and forces the multicomponent mandrel upper part 11*a* downhole within the multicomponent sliding sleeve 17. This urges the bias element push component 44 and the upper bias element push ring 60 to compress the bias element elastomeric tube 58 (or the bias element compression spring 80) as the bias element support component 46 is forced downhole. The compressed bias element elastomeric tube 58 urges the respective transition sleeve ends 50, 52, the connection joint 54 and the initial set sub mandrel component 96 downhole, which compresses the lower packer element 100 and urges the two-part lower packer element compression sleeve 102 downhole against the resistance of the drag blocks 120. This forces the mechanical slips 116 up the respective uphole and downhole slip ramps and into engagement with a casing of a cased well bore, thereby locking the straddle packer 10, 10*a* in the cased well bore as the mechanical slips 116 bite the well casing (not shown). As the bias element elastomeric tube 58 further compresses under the work string weight load, it increases in diameter to fill the bias element chamber 56 (see FIG. 2) sealing mandrel ports 64 in the bias element support component 46 and transition sleeve ports 66 in the transition sleeve upper end 50 to prevent any escape through the mandrel ports 64 of high-pressure fluid pumped into the straddle packer 10. Meanwhile, downhole movement of the multicomponent mandrel lower part 11*b* moves the unload sub mandrel ports 137 past the unload sub sleeve ports 135 and a captive seal 150 retained by a captive seal ring 152 inhibits any high-pressure fluid pumped into the straddle packers 10, 10*a* from escaping through the unload sub sleeve ports 135. However, if a screen-out (well understood in the art) occurs, relieving work string weight at the surface lets the bias element elastomeric tube 58 (or bias element compression spring 80) relax as shown in FIGS. 2 and 3, to move the unload sub mandrel component 136 uphole and provide fluid communication between the unload sub mandrel component ports 137 and the unload sub sleeve ports 135 to dump fluid from the straddle packer 10, 10*a*. In the event that this fluid path is obstructed for any reason, the mandrel ports 64 provide a fluid path around opposed ends of the relaxed bias element elastomeric tube 58 and out through the transition sleeve ports 66 to permit high-pressure fluid trapped in the straddle packer 10 to drain into an annulus of the well bore. The bias element elastomeric tube 58 (and the bias element compression spring 80) also assists the return of the straddle packer 10 to the run-in condition after string weight is removed from the work string, and prevents premature setting of the packer elements 18, 100 in the event an obstruction is tagged in the well bore while the straddle packer 10 is being run into the well bore.

Once the mechanical slips 116 have been engaged and the upper packer element 18 and lower packer element 100 are in the initial-set condition, high-pressure fluid can be pumped into the straddle packer 10, 10*a*. The high-pressure fluid exits the flow sub nozzles 32, but as the pump rate increases the high-pressure fluid is forced through packer element piston ports 106 of the packer element piston mandrel component 108 and into packer element piston chamber 112, urging the two-part lower packer element compression sleeve 102 uphole away from the packer element piston 110 to boost the setting pressure on the lower packer element 100. This in turns causes the pressure-boosted compression of the lower packer element 100 to urge the initial set sub mandrel component 96, the connection joint 54, and the respective transition sleeves 50, 52 uphole, further compressing the bias element elastomeric tube 58 (or the bias element compression spring 80) and urging the multicomponent sliding sleeve 17 against the upper packer element to fluid pressure-boost the set of the upper packer element 18, balancing pressure-boost compression on the upper packer element 18 and the lower packer element 100. The higher the fluid-pressure in the straddle packer 10, 10*a*, the greater the fluid pressure-boosted setting of the respective packer elements 18, 100.

Figure 5A:
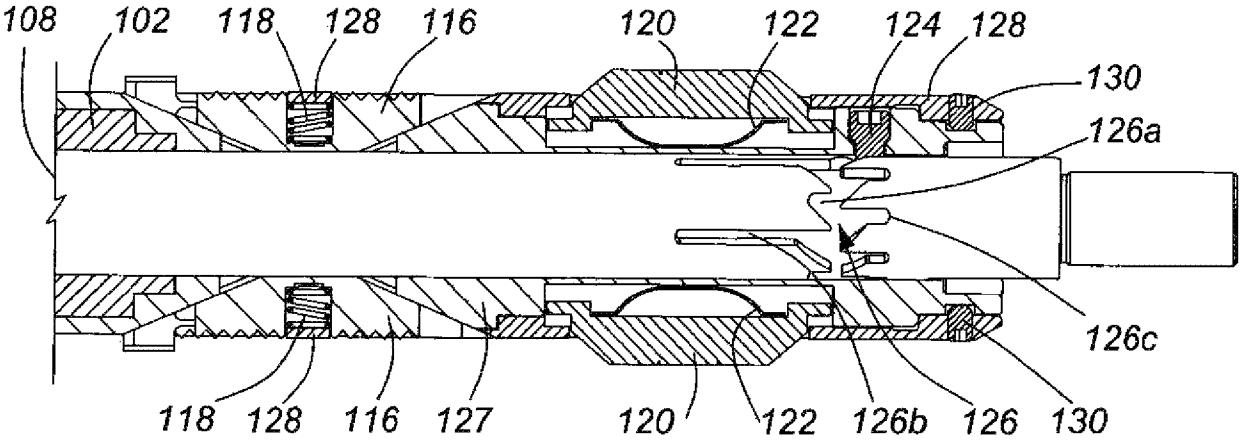
FIG. 5*a* is a schematic detailed view in partial cross-section of an auto-j ratchet of the straddle packer shown in FIG. 1.

FIG. 5*a* is a schematic detailed view in partial cross-section of the auto-j ratchet groove 126 of the straddle packer shown in FIGS. 1-4. In this view, the auto-J ratchet lug 124 is in a neutral notch 126*a* of the auto-J ratchet groove 126. In the neutral notch 126*a*, the mechanical slips 116 are urged to a retracted position by the slip springs 118, which are retained by the drag block/slip retainer ring 128, and the straddle packer 10, 10*a* can be pushed downhole against the resistance of the drag blocks 120.

Figure 5B:
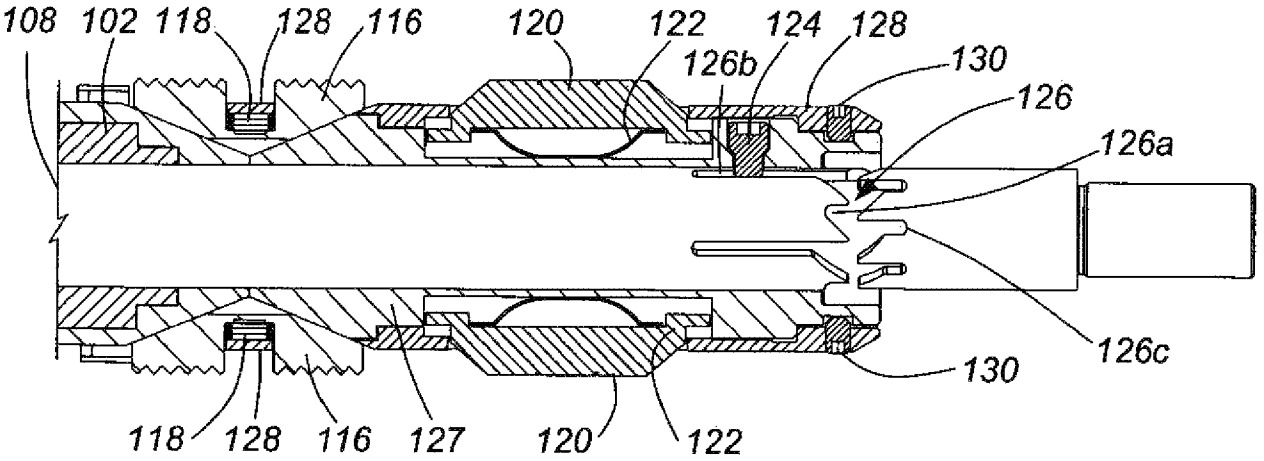
FIG. 5*b* is a schematic detailed view in partial cross-section of the auto-j ratchet shown in FIG. 5*a* with an auto-J ratchet lug in a slip engage notch of the auto-J ratchet.

FIG. 5*b* is a schematic detailed view in partial cross-section of the auto-j ratchet lug 124 of the straddle packer 10, 10*a* in the slip engage notch 126*b*. When the auto-J ratchet lug 124 enters the slip engage notch 126*b*, the upper and lower multicomponent mandrel parts 11*a*, 11*b* can be pushed downhole through the straddle packer 10, 10*a* which closes the unload sub mandrel ports 137, sets the mechanical slips 116 and compresses the upper packer element 18 and the lower packer element 100 to the initial set position, as described above with reference to FIG. 4. Shifting from the auto-J ratchet neutral notch 126*a* to the auto-J ratchet slip engage notch 126*b*, or vice versa, is accomplished by pulling up on the work string, which moves the auto-J ratchet lug 124 into an auto-J ratchet shift notch 126*c*. A subsequent downward push on the work string moves the auto-J ratchet to a subsequent notch of the auto-J ratchet groove 126. The shift occurs automatically and without any action required on the part of the operator aside from the required pull up on the work string followed by a push down on the work string.

The explicit embodiments of the invention described above have been presented by way of example only. The scope of the invention is therefore intended to be limited solely by the scope of the appended claims.

I claim:

1. A compression-set straddle packer, comprising a two-part multicomponent mandrel and a two-part transition sleeve between an upper part and a lower part of the two-part multicomponent mandrel the two part transition sleeve comprising a bias element chamber that houses a bias element supported on a bias element support component of the upper part of the two-part multicomponent mandrel below a bias element push component of the upper part of the two-part multicomponent mandrel, the bias element constantly resisting movement of the upper part of the two-part multicomponent mandrel toward a lower end of the two-part transition sleeve, the bias element comprises an elastomeric tube with an upper bias element push ring between the bias element push component and the bias element, and a lower bias element push ring between the bias element and the lower end of the bias element chamber, and the bias element support component comprises fluid ports and the transition sleeve upper end comprises fluid ports.

2. The compression-set straddle packer as claimed in claim 1 wherein the upper part of the two-part multicomponent mandrel comprises: a work string connection component which is threadedly connected to an upper mandrel tube, the work string connection component supporting an upper packer element; a mandrel flow sub connected to a downhole end of the upper mandrel tube; at least one mandrel flow sub nozzle in the mandrel flow sub; a lower mandrel tube connected to a downhole end of the mandrel flow sub; the bias element push component connected to a downhole end of the lower mandrel tube; the bias element support component connected to a downhole end of the bias element push component and a mandrel termination component connected to a downhole end of the bias element support component.

3. The compression-set straddle packer as claimed in claim 1 wherein the lower part of the two-part multicomponent mandrel comprises: an initial set sub mandrel component connected to a connection joint that is connected to a lower end of the two-part transition sleeve, the initial sub set mandrel component supporting a lower packer element; a packer element piston mandrel component connected to the initial set sub mandrel component; an unload sub mandrel component connected to the packer element piston mandrel component; and, a collar locator mandrel component connected to the unload sub mandrel component.

4. The compression-set straddle packer as claimed in claim 2 further comprising a multicomponent sliding sleeve that reciprocates within a limited range on the upper part of the two-part multicomponent mandrel, the multicomponent sliding sleeve comprising: an upper sliding sleeve connected to a compression bell that slides over a downhole end of a packer element sleeve of the work string connection component, the upper sliding sleeve sliding over the upper mandrel tube; a slotted sliding sleeve connected to a downhole end of the upper sliding sleeve, the slotted sliding sleeve sliding over the mandrel flow sub and having slotted sliding sleeve finger components that define slots that expose the at least one mandrel flow sub nozzle; a lower sliding sleeve connected to a downhole end of the slotted sliding sleeve, a downhole end of the lower sliding sleeve being connected to an upper end of the two-part transition sleeve.

5. The compression-set straddle packer as claimed in claim 3 further comprising: a two-part lower packer element sleeve having an uphole end that abuts the lower packer element, the two-part lower packer element sleeve reciprocating on the packer element piston mandrel component; a drag block/slip sub below a downhole end of the two-part lower packer element sleeve, the drag block/slip sub supporting mechanical slips for anchoring the compression-set straddle packer, drag blocks for inhibiting movement of the compression-set straddle packer, and an auto-J ratchet lug that engages an auto-J ratchet groove in a downhole end of the packer element piston mandrel component; a lower tandem sub connected to the drag block/slip sub; an unload sub sleeve connected to the tandem sub and reciprocating on the unload sub mandrel component; and a collar locator sleeve that supports collar locator ribs, the collar locator sleeve reciprocating on the collar locator mandrel component.

6. A compression-set straddle packer with fluid pressure-boosted packer set, comprising:

a two-part multicomponent mandrel, and a two-part transition sleeve between an upper part and a lower part of the two-part multicomponent mandrel, the two part transition sleeve comprising a bias element chamber that houses a bias element supported on a bias element support component of the upper part of the two-part multicomponent mandrel below a bias element push component of the upper part of the two-part multicomponent mandrel, the bias element constantly resisting movement of the upper part of the two-part multicomponent mandrel-toward a lower end of the two-part transition sleeve;

an upper packer element supported by a work string connection component of the upper part of the two-part multicomponent mandrel, and a lower packer element supported by an initial set sub mandrel component of a lower part of the two-part multicomponent mandrel;

a mandrel flow sub having at least one mandrel flow sub nozzle, the mandrel flow sub being a component of the upper part of the two-part multicomponent mandrel between the upper packer element and the lower packer element;

a packer element piston mandrel component connected to a downhole end of the initial set sub mandrel component and including packer element piston ports;

a two-part lower packer element compression sleeve that reciprocates on the packer element piston mandrel component and has an uphole end that abuts the lower packer element, and defines a packer element piston chamber that is in fluid communication with the packer element piston ports;

whereby when high pressure fluid is pumped into the straddle packer, the high-pressure fluid exits the at least one flow sub nozzle and flows through the packer element piston ports into the packer element piston chamber to urge the uphole end of the two-part packer element compression sleeve against the lower packer element to pressure-boost the lower packer element set and the bias element balances the pressure-boost between the lower packer element and the upper packer element.

7. The compression-set straddle packer with fluid pressure-boosted packer set as claimed in claim 6 wherein the upper part of the two-part multicomponent mandrel comprises: the work string connection component which is threadedly connected to an upper mandrel tube; the mandrel flow sub connected to a downhole end of the upper mandrel tube; a lower mandrel tube connected to a downhole end of the mandrel flow sub; the bias element push component connected to a downhole end of the lower mandrel tube; the bias element support component connected to a downhole end of the bias element push component and a mandrel termination component connected to a downhole end of the bias element support component.

8. The compression-set straddle packer with fluid pressure-boosted packer set as claimed in claim 6 wherein the lower part of the two-part multicomponent mandrel comprises: the initial set sub mandrel component connected to a connection joint that is connected to a lower end of the two-part transition sleeve; the packer element piston mandrel component connected to the initial set sub mandrel component; an unload sub mandrel component connected to the packer element piston mandrel component; and, a collar locator mandrel component connected to the unload sub mandrel component.

9. The compression-set straddle packer with fluid pressure-boosted packer set as claimed in claim 8 further comprising a multicomponent sliding sleeve that reciprocates within a limited range on the upper part of the two-part multicomponent mandrel, the multicomponent sliding sleeve comprising: an upper sliding sleeve connected to a compression bell that slides over a downhole end of a packer element sleeve of the work string connection component, the upper sliding sleeve sliding over the upper mandrel tube; a slotted sliding sleeve connected to a downhole end of the upper sliding sleeve, the slotted sliding sleeve sliding over the mandrel flow sub and having slotted sliding sleeve finger components that define slots that expose the at least one mandrel flow sub nozzle; a lower sliding sleeve connected to a downhole end of the slotted sliding sleeve, a downhole end of the lower sliding sleeve being connected to an upper end of the two-part transition sleeve.

10. The compression-set straddle packer with fluid pressure-boosted packer set as claimed in claim 9 further comprising: the two-part lower packer element sleeve; a drag block/slip sub below a downhole end of the two-part lower packer element sleeve, the drag block/slip sub supporting mechanical slips for anchoring the compression-set straddle packer, drag blocks for inhibiting movement of the compression-set straddle packer, and an auto-J ratchet lug that engages an auto-J ratchet groove in a downhole end of the packer element piston mandrel component; a lower tandem sub connected to the drag block/slip sub; an unload sub sleeve connected to the tandem sub and reciprocating on the unload sub mandrel component; and a collar locator sleeve that supports collar locator ribs, the collar locator sleeve reciprocating on the collar locator mandrel component.

11. The compression-set straddle packer with fluid pressure-boosted packer set as claimed in claim 6 wherein the bias element comprises an elastomeric tube.

12. The compression-set straddle packer with fluid pressure-boosted packer set as claimed in claim 6 wherein the bias element comprises a compression spring.

13. The compression-set straddle packer with fluid pressure-boosted packer set as claimed in claim 11 further comprising an upper bias element push ring between the bias element push component and the bias element, and a lower bias element push ring between the bias element and the lower end of the bias element chamber.

14. The compression-set straddle packer with fluid pressure-boosted packer set as claimed in claim 13 wherein the bias element support component comprises fluid ports and the transition sleeve upper end comprises fluid ports.

15. The compression-set straddle packer with fluid pressure-boosted packer set as claimed in claim 10 wherein the unload sub mandrel component comprises unload sub mandrel ports that are in fluid communication with unload sleeve ports in the unload sub sleeve when the compression-set straddle packer is in a run-in condition so that fluid in a central passage of the two-part multicomponent mandrel can unload from the straddle packer, and the respective unload sub mandrel ports and unload sub sleeve ports are not in fluid communication when the straddle packer is shifted from the run-in condition to an initial set condition.

16. A compression-set straddle packer with fluid pressure-boosted packer set, comprising:

a two-part multicomponent mandrel, an upper part of the two-part multicomponent mandrel having a work string connection end that supports a packer element, the multicomponent mandrel extending from the work string connection end to a connection joint of the straddle packer an upper mandrel tube threadedly connected to the work string connection component; a mandrel flow sub having at least one mandrel flow sub nozzle connected to a downhole end of the upper mandrel tube; a lower mandrel tube connected to a downhole end of the mandrel flow sub; a bias element push component connected to a downhole end of the lower mandrel tube; a bias element support component connected to a downhole end of the bias element push component and a mandrel termination component connected to a downhole end of the bias element support component;

a multicomponent sliding sleeve that surrounds the upper part of the two-part multicomponent mandrel below the work string connection end and reciprocates on the upper part of the two-part multicomponent mandrel within a limited range, the multicomponent sliding sleeve including an upper sliding sleeve connected to a compression bell that slides over a downhole end of a packer element sleeve of the work string connection component, the upper sliding sleeve sliding over the upper mandrel tube; a slotted sliding sleeve connected to a downhole end of the upper sliding sleeve, the slotted sliding sleeve sliding over the mandrel flow sub and having slotted sliding sleeve finger components that define slots that expose the at least one mandrel flow sub nozzle; a lower sliding sleeve connected to a downhole end of the slotted sliding sleeve; a transition sleeve upper end connected to a downhole end of the lower sliding sleeve; a transition sleeve lower end connected to a downhole end of the transition sleeve upper end, the upper and lower sliding sleeves providing a bias element chamber that houses the bias element push component and the bias element support component of the multicomponent mandrel; and the connection joint which is connected to the transition sleeve lower end;

a bias element supported on the bias element support component of the multicomponent mandrel between the bias element push component and a lower end of the bias element chamber, the bias element constantly resisting movement of the multicomponent sliding sleeve toward the work string connection;

the lower part of the two-part multicomponent mandrel comprising: an initial set sub mandrel component connected to the connection joint, the initial sub set mandrel component supporting a lower packer element; a packer element piston mandrel component connected to the initial set sub mandrel component; an unload sub mandrel component connected to the packer element piston mandrel component; and, a collar locator mandrel component connected to the unload sub mandrel component; and a two-part lower packer element sleeve having an uphole end that abuts the lower packer element, the two-part lower packer element sleeve reciprocating on the packer element piston mandrel component; a drag block/slip sub below a downhole end of the two-part lower packer element sleeve, the drag block/slip sub supporting mechanical slips for anchoring the compression-set straddle packer, drag blocks for inhibiting movement of the compression-set straddle packer, and an auto-J ratchet lug that engages an auto-J ratchet groove in a downhole end of the packer element piston mandrel component; a lower tandem sub connected to the drag block/slip sub; an unload sub sleeve connected to the tandem sub and reciprocating on the unload sub mandrel component; and a collar locator sleeve that supports collar locator ribs, the collar locator sleeve reciprocating on the collar locator mandrel component.

* * * * *